US008147294B2

(12) United States Patent
Sasaki et al.

(10) Patent No.: US 8,147,294 B2
(45) Date of Patent: Apr. 3, 2012

(54) CAPILLARY, CAPILLARY POLISHING METHOD, AND CAPILLARY POLISHING APPARATUS

(75) Inventors: Jun Sasaki, Kawasaki (JP); Akihiko Yabuki, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 1147 days.

(21) Appl. No.: 11/987,579

(22) Filed: Nov. 30, 2007

(65) Prior Publication Data

US 2008/0176490 A1 Jul. 24, 2008

(30) Foreign Application Priority Data

Jan. 19, 2007 (JP) ..... 2007-010605
Mar. 30, 2007 (JP) ..... 2007-094948

(51) Int. Cl.
*B24B 1/00* (2006.01)

(52) U.S. Cl. ..... 451/41; 451/36; 451/59; 451/279

(58) Field of Classification Search ..... 451/28, 451/36, 41, 59, 113, 278, 279, 909; 29/423, 29/33 F See application file for complete search history.

(56) References Cited

U.S. PATENT DOCUMENTS 5,539,973 A * 7/1996 Smith et al. ..... 29/558
5,575,708 A * 11/1996 Chau et al. ..... 451/305
5,630,268 A * 5/1997 Smith et al. ..... 29/557
5,993,296 A * 11/1999 Rogers ..... 451/49
6,015,338 A * 1/2000 Hong et al. ..... 451/541
6,018,860 A * 2/2000 Smith et al. ..... 29/558
6,214,030 B1 * 4/2001 Matsutani et al. ..... 606/223
7,465,218 B2 * 12/2008 Kobayashi ..... 451/28
2005/0191952 A1 * 9/2005 Mitarai ..... 451/314
2005/0250197 A1 11/2005 Ando et al.
2007/0122548 A1 5/2007 Inaba et al.
2008/0182483 A1 * 7/2008 Kobayashi ..... 451/28

FOREIGN PATENT DOCUMENTS

JP 2004-525713 8/2004
JP 2005-318851 11/2005
WO 98/28406 7/1998
WO 02/083232 10/2002

OTHER PUBLICATIONS

Extended European Search Report for corresponding application 07121908.3-2302 mailed on May 15, 2008.
"BV-10 Microelectrode Beveler," Shoshin EM Corporation, Shutter Instrument [online], URL:http://www.shoshinem.com/bv-10.htm with corresponding English catalogue (accessed Jan. 11, 2007).
Japanese Office Action issued Feb. 7, 2012 in corresponding Japanese Patent Application No. 2007-094948 (2 pages, 3 pages English translation).
"Injection Systems—Narishige Micromanipulation Systems," Narishige Co., Ltd., 2003, p. 34 (3 pages).

* cited by examiner

*Primary Examiner* — Eilleen P. Morgan
(74) *Attorney, Agent, or Firm* — Staas & Halsey LLP

(57) ABSTRACT

A tip of a capillary used for microinjection is polished on a plurality of sides by using a polishing plate having a surface roughened by dry etching. A first side of the tip is placed on the polishing plate at a predetermined angle and with a predetermined amount of pressing. The polishing plate is repeatedly moved at a predetermined speed by a predetermined distance such that the first side is polished. The capillary is then rotated around an axis thereof to obtain a second side of the tip, and the process of polishing is repeated for the second side.

8 Claims, 16 Drawing Sheets

IMAGE STATISTICS

| | | |
|---|---|---|
| Img. | Z range | 2.345 nm |
| Img. | Rms (Rq) | 0.2776 nm |
| Img. | Ra | 0.222 nm |
| Img. | Rmax | 2.345 nm |
| Img. | Srf, area | 25.003 $\mu m^2$ |
| Img. | Srf, area diff | 0.012% |
| Img. | SAE | 1.000 |

BOX STATISTICS

| | |
|---|---|
| Z range | 2.075 nm |
| Mean | -0.017 nm |
| Raw mean | -33.185 nm |
| Rms (Rq) | 0.156 nm |
| Mean roughness (Ra) | 0.123 nm |
| Max height (Rmax) | 1.563 nm |
| Peak Threshold | |

IMAGE STATISTICS

| | | |
|---|---|---|
| Img. | Z range | 50.727 nm |
| Img. | Rms (Rq) | 7.312 nm |
| Img. | Ra | 5.906 nm |
| Img. | Rmax | 50.727 nm |
| Img. | Srf, area | 25.330 µm² |
| Img. | Srf, area diff | 1.321% |
| Img. | SAE | 1.006 |

BOX STATISTICS

| | |
|---|---|
| Z range | 46.813 nm |
| Mean | 0.048 nm |
| Raw mean | 959.36 nm |
| Rms (Rq) | 7.377 nm |
| Mean roughness (Ra) | 5.960 nm |
| Max height (Rmax) | 46.980 nm |
| Peak Threshold | |

INDICATING CONTACT POSITION OF TIP AT CONTACT AREA

MOVING TIP TO STARTING POSITION IN POLISHING AREA

POLISHING OF TIP

CAPILLARY, CAPILLARY POLISHING METHOD, AND CAPILLARY POLISHING APPARATUS

BACKGROUND OF THE INVENTION

1. Field of the Invention

The present invention relates to a technology of polishing a capillary used for microinjection.

2. Description of the Related Art

Microinjection technique is used to inject a drug solution into a cell. The cell is penetrated by a tip of a capillary that is made of a hollow glass needle and filled with the drug solution. Generally, the tip of the capillary is processed to have a very small outer diameter of about 1 micrometer.

Even then, the capillary does not have enough penetrating ability with respect to cells such as floating cells, resulting in insufficient injection of the drug solution. To enhance the penetrating ability of the capillary, the tip can be subjected to angled-polishing or processed to have an even smaller diameter.

One method of angled-polishing is to subject the tip to focused ion beam (FIB) milling. Another method is to use a capillary polishing apparatus that includes a diamond polishing plate or an alumina polishing plate. For a more complete description of such a capillary polishing apparatus, reference may be had to, e.g., a website as follows:

Shoshin EM Corporation, "Sutter Instrument", [online], [accessed on Jan. 11, 2007], Internet <URL: http://www.shoshinem.com/bv-10.htm>

However, in the case of FIB milling, the required setup is expensive, which increases the manufacturing cost of the capillary. In the case of using a conventional capillary polishing apparatus, a capillary having a tip diameter of about 1 micrometer is polished on a polishing plate having a surface roughness Ra of about 0.05 micrometer, which results in cracks around the tip. Moreover, if the tip diameter is further reduced, it is not possible to secure a discharge nozzle of sufficient size. As a result, the capillary gets clogged with the drug solution.

SUMMARY OF THE INVENTION

It is an object of the present invention to at least partially solve the problems in the conventional technology.

According to an aspect of the present invention, a capillary polishing method of polishing a tip of a capillary for microinjection, includes first-polishing a first side of the tip by placing the tip on a polishing plate at a predetermined angle, pressing the tip against the polishing plate by a predetermined amount, and repeatedly moving the polishing plate at a predetermined speed by a predetermined distance, the polishing plate having a surface roughened by dry etching; rotating the capillary around an axis thereof to determine a second side of the tip; and second-polishing the second side by placing the tip on the polishing plate at a predetermined angle, pressing the tip against the polishing plate by a predetermined amount, and repeatedly moving the polishing plate at a predetermined speed by a predetermined distance.

According to another aspect of the present invention, a capillary polishing apparatus that polishes a tip of a capillary for microinjection, includes a polishing mechanism that includes a polishing plate having a surface roughened by dry etching; and a capillary holding mechanism that holds the capillary. The polishing plate and the capillary holding mechanism move relative to each other at a predetermined speed such that the tip is placed on the polishing plate at a predetermined angle and pressed against the polishing plate by a predetermined amount. The capillary holding mechanism rotates the capillary around an axis of the capillary after the tip is polished.

According to still another aspect of the present invention, a capillary for microinjection has a tip from which a solution is injected into a target object. The tip is polished on a plurality of sides, and a curvature of the tip is less than or equal to 0.2μ.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described in detail below with reference to the accompanying drawings. The present invention is not limited to these exemplary embodiments.

Figure 23:
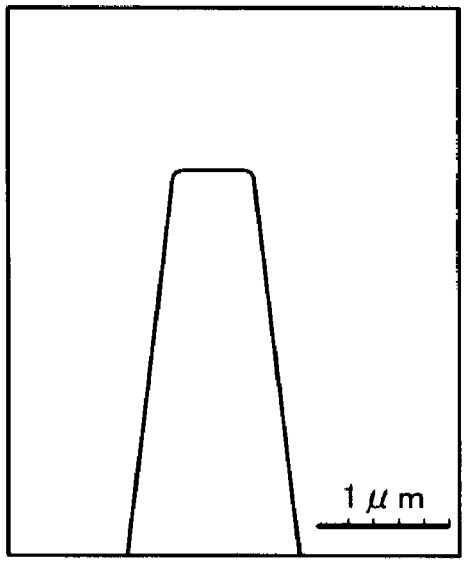
FIG. 23 is an example of a conventional capillary.

First, conventional capillaries are described below with reference to FIGS. 23 and 24. FIG. 23 is an example of a conventional capillary (hereinafter, "first conventional capillary"). The first conventional capillary is manufactured from a hollow glass tube having an outer diameter of about 1 millimeter and an inner diameter of about 0.5 millimeter. The glass tube is elongated while being heated to reduce its diameter. The glass tube is divided into two pieces at a portion with the smallest diameter. Each piece is used as the first conventional capillary that has a tip with an outer diameter of about 1 micrometer and an inner diameter of about 0.5 micrometer.

Figure 24:
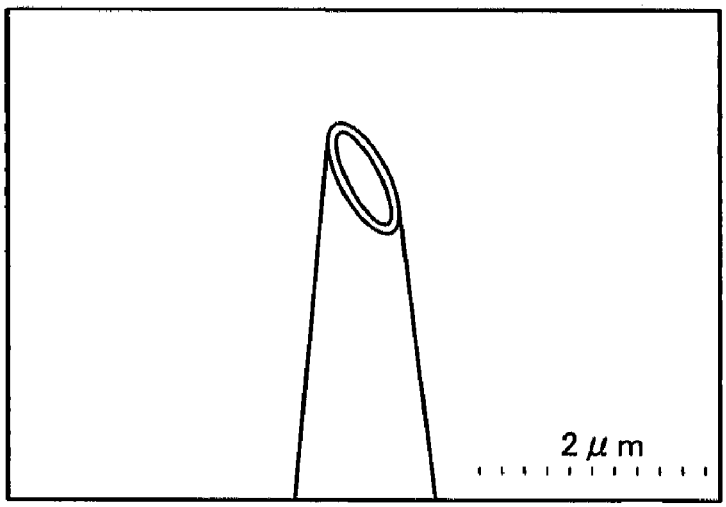
FIG. 24 is another example of a conventional capillary.

FIG. 24 is another example of a conventional capillary (hereinafter, "second conventional capillary"). The second conventional capillary is manufactured in the same manner as the first conventional capillary except that the tip of the second conventional capillary is subjected to focused ion beam (FIB) milling.

Although the tip of the first conventional capillary has a small diameter, it is not sharp-pointed, which weakens its penetrating ability. On the other hand, the second conventional capillary has a tip only one side of which is subjected to FIB milling such that the tip becomes sharp-pointed. However, the degree of sharp-pointedness of the tip is not sufficient, resulting in insufficient penetration into cells such as floating cells. Moreover, the setup required to perform FIB milling is expensive, thereby increasing the manufacturing cost of the capillary.

Figure 1:
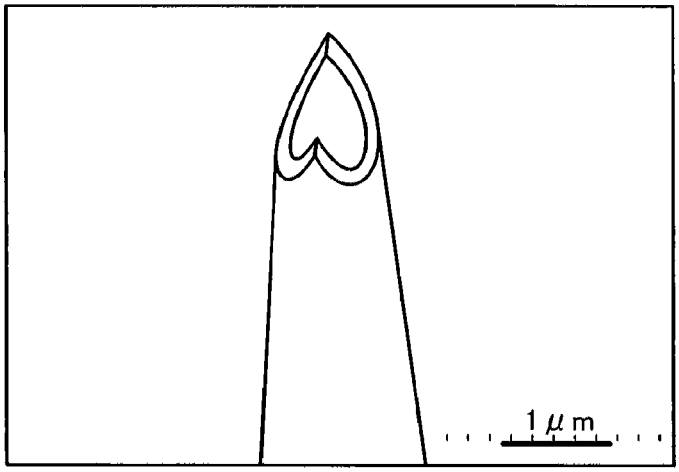
FIG. 1 is an example of a capillary according to a first embodiment of the present invention.

FIG. 1 is an example of a capillary according to a first embodiment of the present invention. The capillary shown in FIG. 1 is manufactured in the same manner as the first conventional capillary except that the tip thereof is subjected to multi-side angled-polishing. That is, after angle-polishing one side of the tip, the capillary is rotated by 90° around its axis to angle-polish the opposite side.

The tip of the capillary shown in FIG. 1 is processed to have a curvature less than or equal to 0.2 micrometer, which enhances its penetrating ability in floating cells. Moreover, a discharge opening of 0.8 micrometer is secured such that the capillary is not clogged with an injecting substance such as a drug solution.

Figure 2:
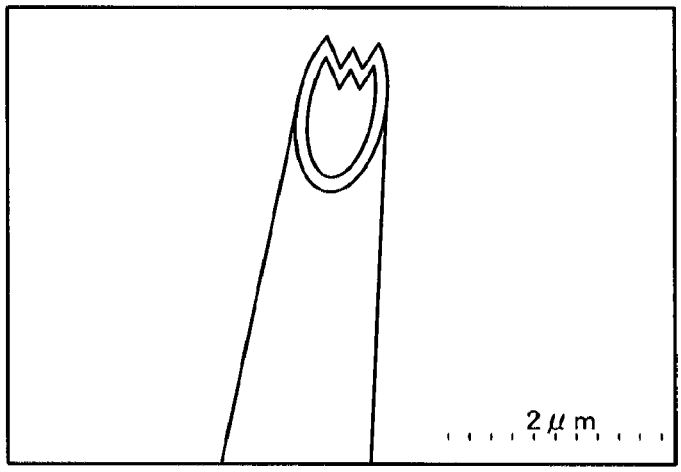
FIG. 2 is another example of a capillary according to the first embodiment.

Meanwhile, after angle-polishing one side of the tip, the rotating angle can be set to be different than 90° depending on the quality of material or the required penetrating ability of the capillary. FIG. 2 is another example of a capillary that is rotated by 180° around its axis for angle-polishing the second time. A protrusion seen at the center of the tip of the capillary shown in FIG. 2 is a glass fiber exposed because of angled-polishing. The glass fiber is inserted in the capillary in advance to facilitate smooth supply of drug solution.

Alternatively, three or more sides of a capillary can be angle-polished by repeatedly rotating the capillary by a predetermined angle.

Figure 3:
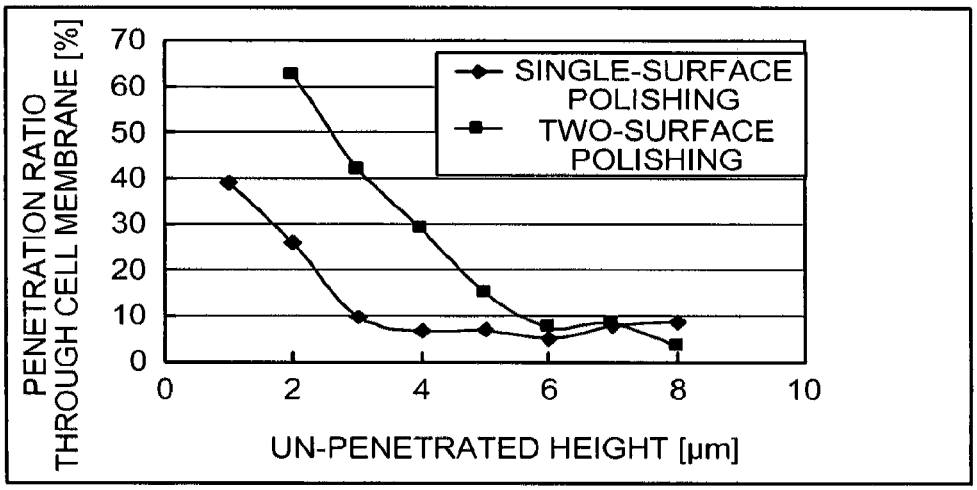
FIG. 3 is a graph for comparing penetrating ability of a capillary according to the first embodiment and a conventional capillary.
Figure 4:
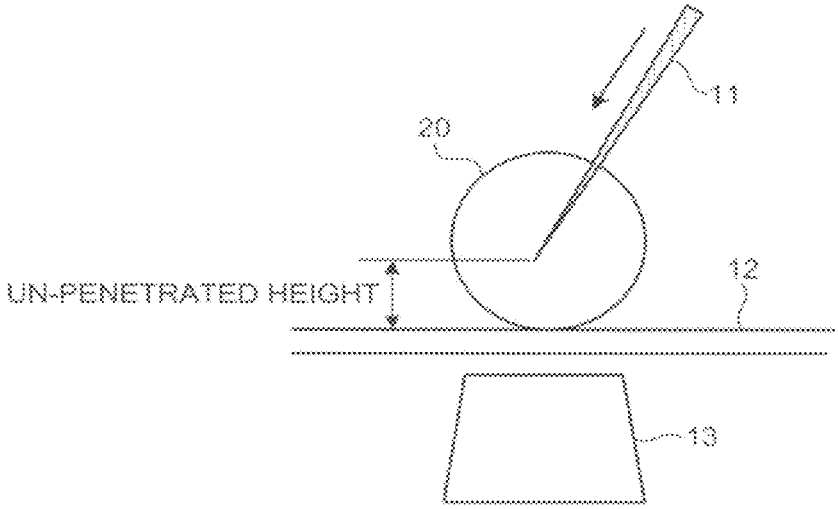
FIG. 4 is a schematic diagram of a mechanism to test the penetrating ability.

A test was conducted to compare penetrating ability of a capillary 11 (the capillary shown in FIG. 1) and the second conventional capillary. The result of the test is shown in FIG. 3. In the test, as shown in FIG. 4, a K562 cell (human chronic myelogenous leukemia cell) 20 with an average diameter of 16 micrometers was adsorbed on a Petri dish 12. The capillary 11 was penetrated from above into the K562 cell 20 to check the penetration ratio of the capillary 11 into the cell membrane of the K562 cell 20. The penetration ratio was obtained with respect to different distances between the Petri dish 12 and the tip of the capillary 11 penetrated into the K562 cell 20 (un-penetrated heights). The penetration ratio of the second conventional capillary was also obtained in the same manner as described above. Penetration ratios thus obtained were plotted as shown in FIG. 3.

A fluorescence solution of 0.6 picoliter was prepared by mixing 2 mg/ml of a fluorescence reagent (Alexa 488 Dextran Conjugate) with phosphate buffered saline (PBS), and was injected into the K562 cell 20. The fluorescence inside the K562 cell 20 was then observed from an inverted microscope 13 arranged beneath the Petri dish 12 to determine whether the capillary 11 had penetrated the cell membrane of the K562 cell 20.

Figure 5:
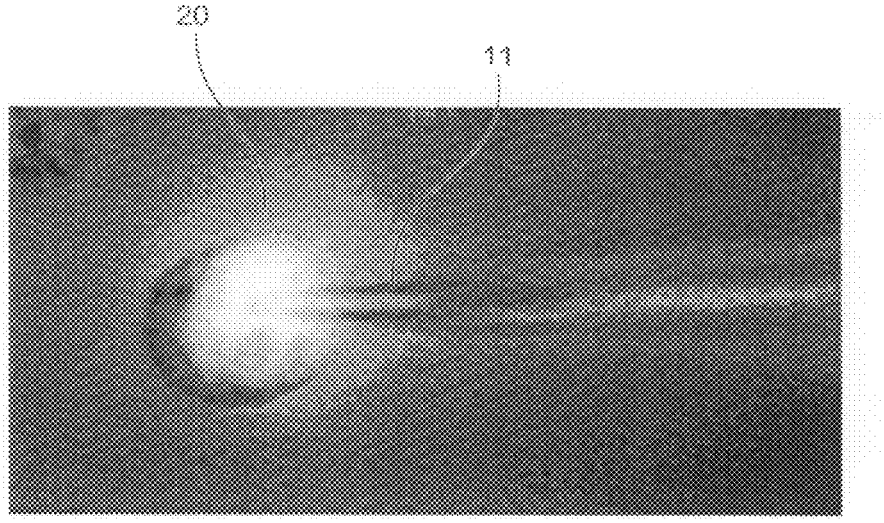
FIG. 5 is an example of a capillary that penetrated a cell membrane.
Figure 6:
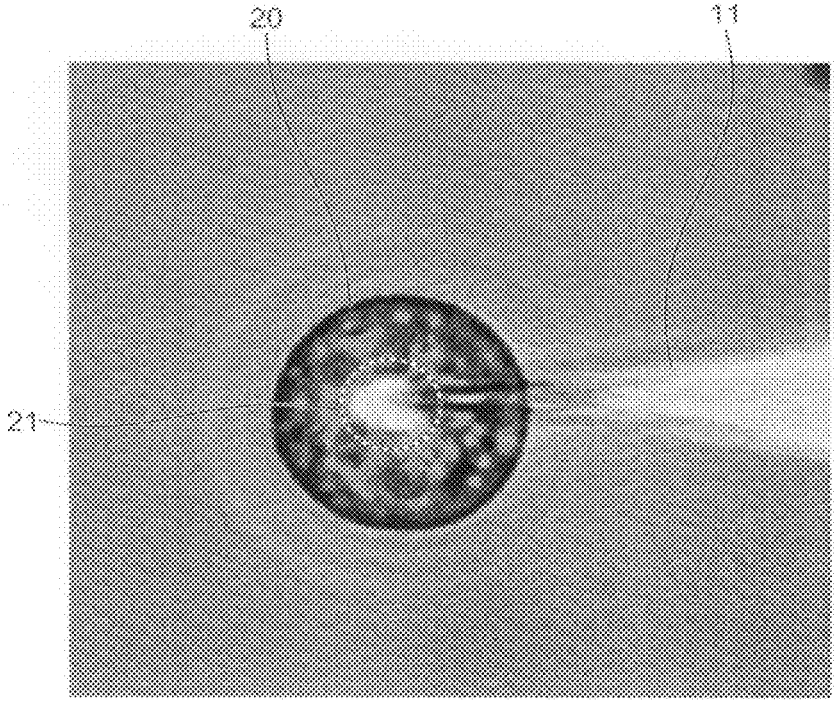
FIG. 6 is an example of a capillary that could not penetrate a cell membrane.

As shown in FIG. 5, when the capillary 11 penetrates the cell membrane of the K562 cell 20, the fluorescence reagent spreads almost throughout the K562 cell 20, thereby generating fluorescence in the K562 cell 20. On the other hand, as shown in FIG. 6, when the capillary 11 does not penetrate the cell membrane of the K562 cell 20, the fluorescence reagent gets trapped in a pouch 21 of the cell membrane and does not spread throughout the K562 cell 20. Moreover, when the capillary 11 is pulled out of the K562 cell 20, the fluorescence reagent trickles out of the K562 cell 20. Hence, it is difficult to observe fluorescence in the K562 cell 20.

It is clear from FIG. 3 that when a capillary is angle-polished on a plurality of sides (such as the capillary according to the first embodiment shown in FIGS. 1 and 2) has a higher penetration ratio than a capillary angle-polished on a single side (such as the second conventional capillary).

Figure 7:
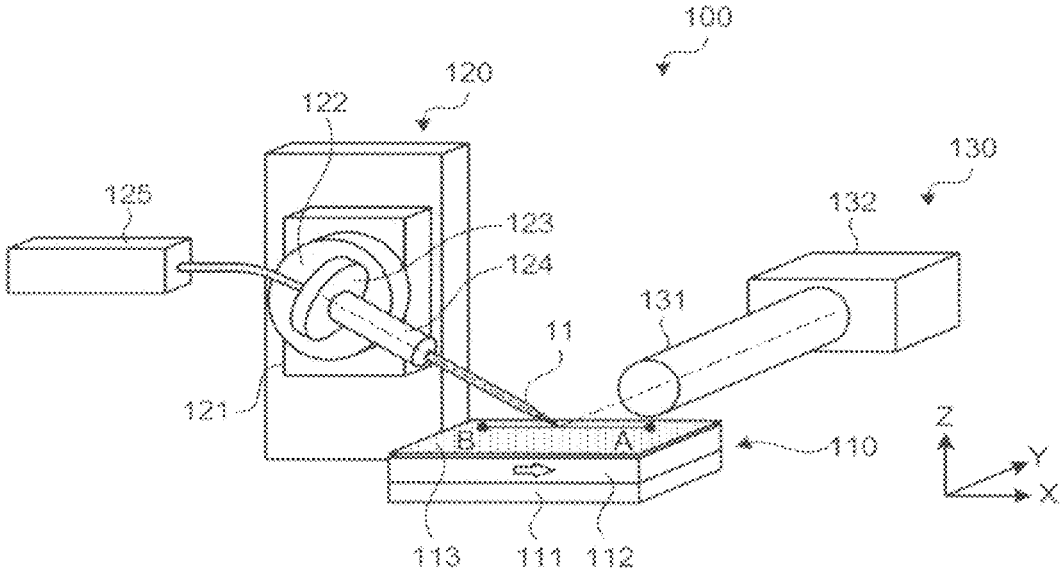
FIG. 7 is a schematic diagram of a capillary polishing apparatus according to the first embodiment.

Given below is the description of a capillary polishing apparatus 100 to polish a capillary as those shown in FIGS. 1 and 2. FIG. 7 is a schematic diagram of the capillary polishing apparatus 100 according to the first embodiment. The capillary polishing apparatus 100 includes a polishing mechanism 110, a capillary holding mechanism 120, and a monitoring mechanism 130.

The polishing mechanism 110 includes a polishing plate 113, a Y-axis stage 111 that horizontally moves the polishing plate 113 in the direction of Y axis, and an X-axis stage 112 that horizontally moves the polishing plate 113 in the direction of X axis.

The capillary holding mechanism 120 includes a Z-axis stage 121 that moves the capillary 11 in the direction of Z axis, a first rotating stage 122 that rotates the capillary 11 around Y axis, a second rotating stage 123 that rotates the capillary 11 around its own axis, a holder 124 that holds the capillary 11, and a pressured-gas supplying unit 125 that supplies a pressured gas to the capillary 11.

The monitoring mechanism 130 is used to observe the tip of the capillary 11, and includes a microscope 131 that generates an enlarged image of the tip and a digital camera 132 that converts the enlarged image into digital data.

The capillary polishing apparatus 100 thus has a relatively simple structure and can be assembled at low cost.

Figure 8:
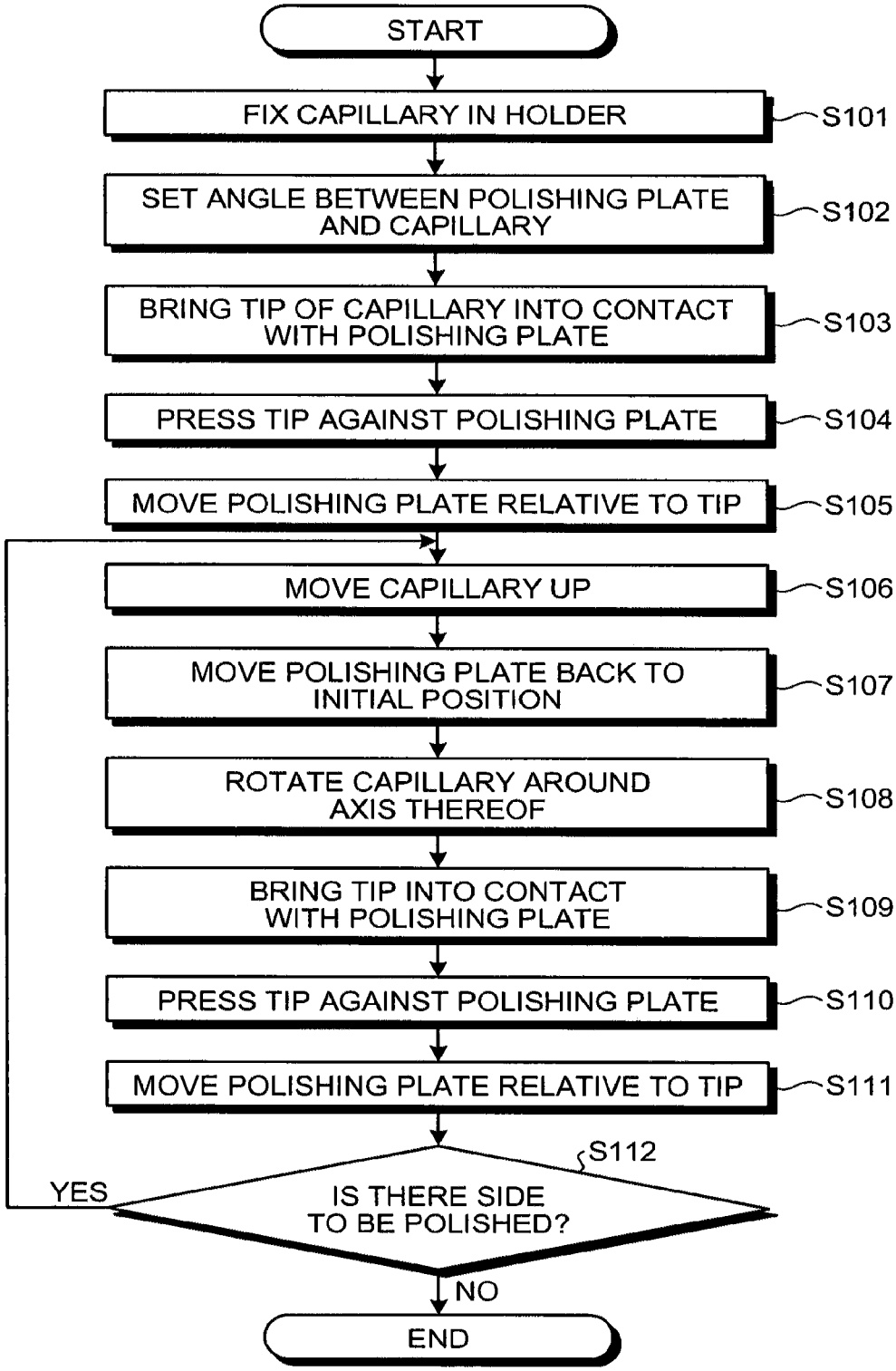
FIG. 8 is a flowchart for explaining a process of polishing a capillary by using the capillary polishing apparatus.

FIG. 8 is a flowchart for explaining the process of polishing the capillary 11 by using the capillary polishing apparatus 100.

First, the capillary 11 to be polished is fixed in the holder 124 (step S101). The capillary 11 is assumed to be manufactured from a hollow glass tube having an outer diameter of about 1 millimeter and an inner diameter of about 0.5 millimeter. The glass tube is elongated while being heated to reduce its diameter. The glass tube is divided into two pieces at a portion with the smallest diameter such that a tip of each piece as the capillary 11 has the smallest diameter.

The first rotating stage 122 is adjusted such that the polishing plate 113 and the axis of the capillary 11 form an angle θ therebetween (step S102). The Z-axis stage 121 is moved down such that the tip makes contact with the polishing plate 113 (step S103).

Figure 9:
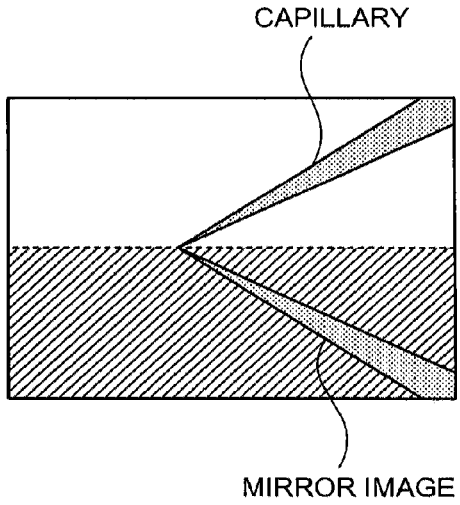
FIG. 9 is a diagram for explaining a process of monitoring a capillary making contact with a polishing plate in the capillary polishing apparatus.

Step S103 is performed while the tip is being monitored from the monitoring mechanism 130. That is, the tip is monitored from the monitoring mechanism 130 while the Z-axis stage 121 is gradually moved down to detect that the tip makes contact with its mirror image on the surface of the polishing plate 113, as shown in FIG. 9.

The Z-axis stage 121 is further moved down such that the tip is pressed against the polishing plate 113 (step S104). The pressing amount δ is determined based on the required amount of polishing. The X-axis stage 112 is horizontally moved in the direction of X axis (between A and B in FIG. 7) at a speed V by a distance L such that the polishing plate 113 performs polishing of the tip (step S105).

When polishing of a first side of the tip is complete, the Z-axis stage 121 is moved up (step S106). The X-axis stage 112 is then moved back to the initial position (step S107). The second rotating stage 123 is rotated by a predetermined rotation angle ω (step S108) such that the capillary 11 rotates around its axis by the angle ω.

The Z-axis stage 121 is again moved down such that the tip makes contact with the polishing plate 113 for the second time (step S109). The Z-axis stage 121 is further moved down such that the tip is pressed against the polishing plate 113 by the pressing amount δ (step S110). The X-axis stage 112 is horizontally moved in the direction of X axis (between A and B in FIG. 7) at the speed V by the distance L such that the polishing plate 113 performs polishing of the tip (step S111).

If the polishing process at step S109 is repeated along the same line on the polishing plate 113, there is a possibility that the polishing quality deteriorates. To prevent that, the Y-axis stage 111 can be moved in the direction of Y axis by a predetermined distance such that the tip is polished along a new line on the polishing plate 113.

When polishing of a second side of the tip is complete, it is determined whether there is another side to be polished (step S112). If there is another side to be polished (YES at step S112), steps S106 to S111 are repeated. If there is no side to be polished (NO at step S112), the process ends.

During the abovementioned polishing process, the pressured gas supplied by the pressured-gas supplying unit 125 passes through the capillary 11. The pressured gas flowing out of the capillary 11 prevents scattering pieces of the capillary 11 from getting attached to the capillary 11. The pressured gas can be, e.g., nitrogen, helium, or dry air of 100 kilopascal.

The angle θ, the pressing amount δ, the speed V, the distance L, and the rotation angle ω can be determined based on the quality of material of the capillary 11, surface roughness of the polishing plate 113, or the required penetrating ability of the capillary 11. For example, the capillary 11 is angle-polished at two sides as that shown in FIG. 1 with θ=30°, δ=4 micrometers, V=250 μm/s, L=50 millimeters, and ω=90°.

Because the diameter of the tip is very small, it is preferred to maintain the surface roughness Ra (i.e., the arithmetic average roughness) of the polishing plate 113 in the range from about 1 nanometer to 10 nanometers such that the tip is polished without being broken.

Figure 10:
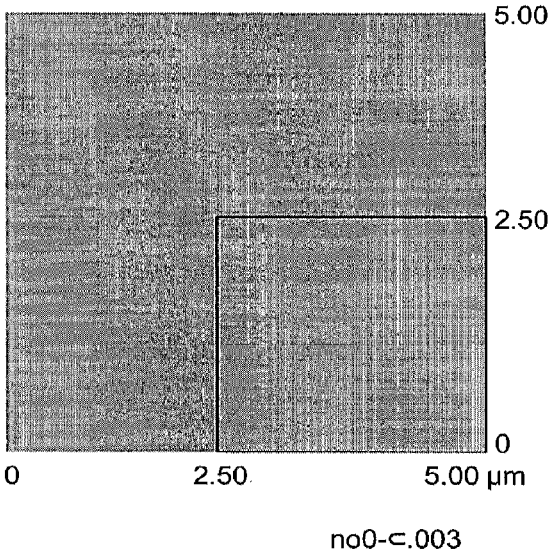
FIG. 10 is a diagram for explaining about surface roughness of a silicon wafer.
Figure 11:
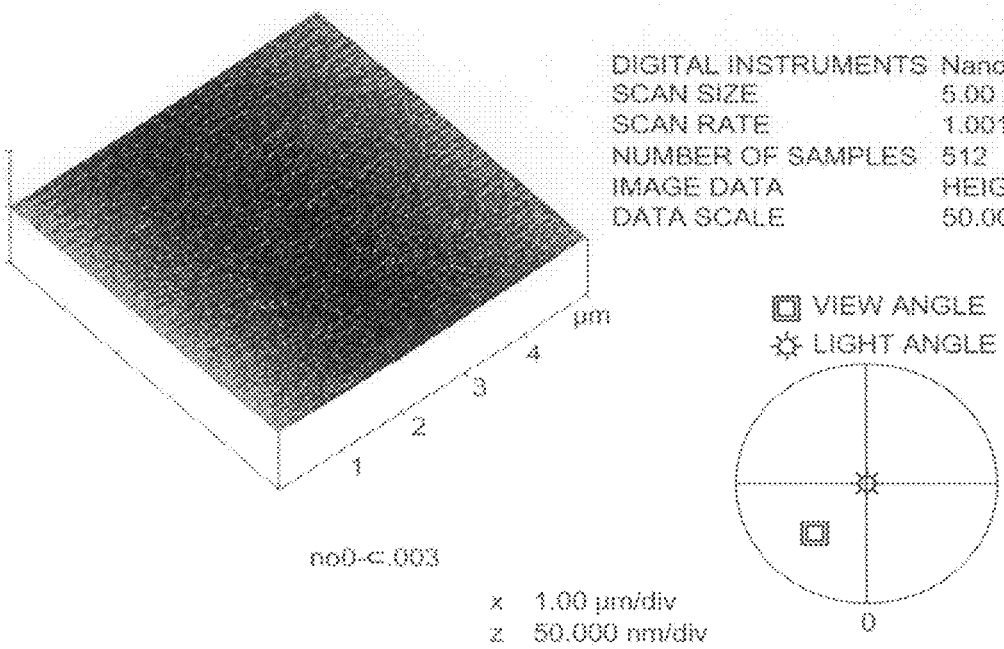
FIG. 11 is an enlarged view of a surface of the silicon wafer.

To obtain such a surface roughness Ra, the polishing plate 113 is manufactured by roughening a smooth surface of a silicon wafer by dry etching it with sulfur hexafluoride (SF6) gas. The silicon wafer before dry etching, as shown in FIG. 10, has a surface roughness Ra of about 0.22 nanometer. That is, the surface of the silicon wafer before dry etching is very smooth as shown in FIG. 11, and is not useful for polishing the capillary 11.

Figure 12:
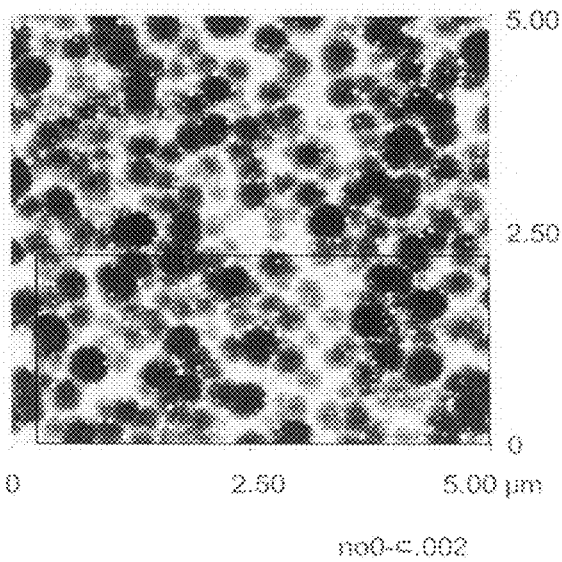
FIG. 12 is a diagram for explaining about surface roughness of the silicon wafer subjected to dry etching with SF6 gas.
Figure 13:
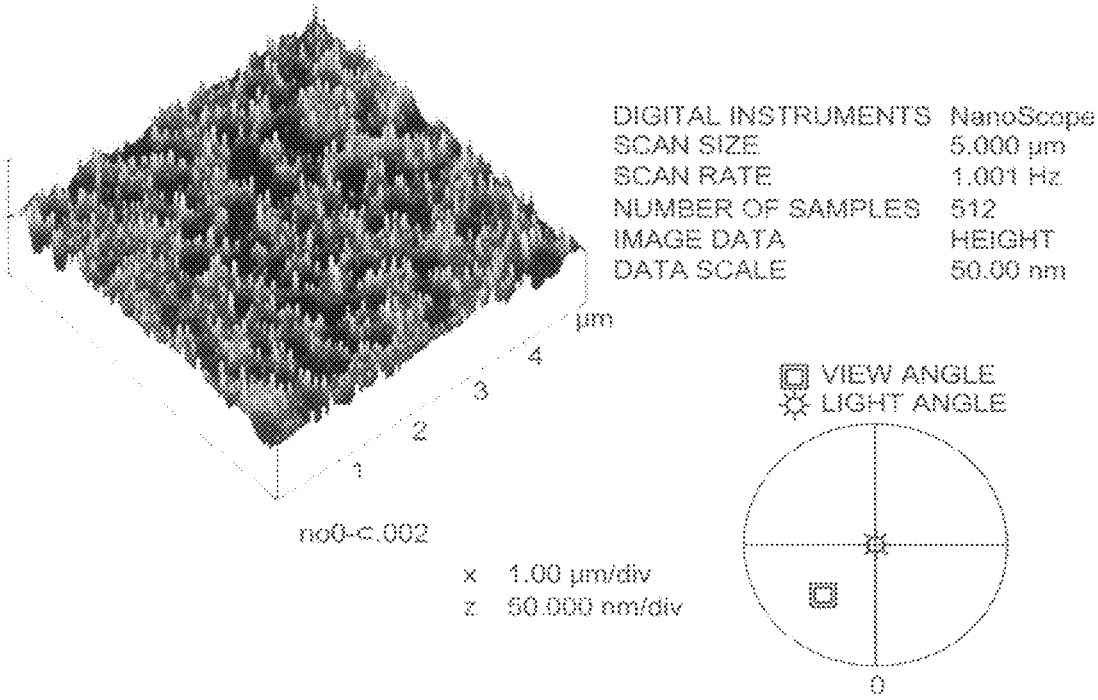
FIG. 13 is an enlarged view of a surface of the silicon wafer.

By dry etching the silicon wafer with SF6 gas, its surface roughness Ra increases to about 5.91 nanometers as shown in FIG. 12. As a result, the surface becomes suitable for polishing the capillary 11 as shown in FIG. 13.

Figure 14:
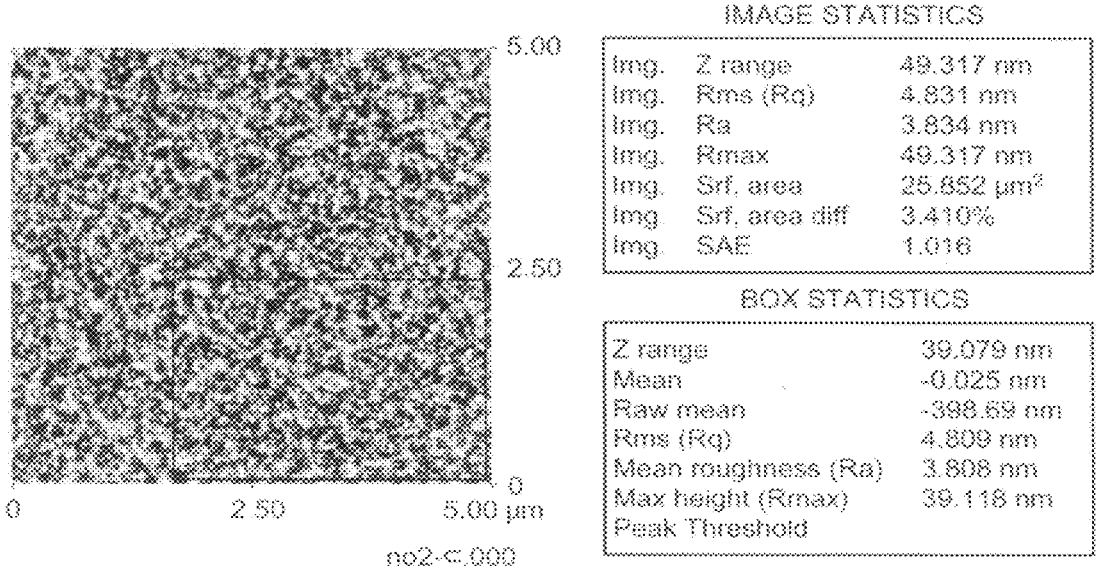
FIG. 14 is a diagram for explaining about surface roughness of the silicon wafer subjected to dry etching with alternate use of SF6 gas and C4F8 gas.
Figure 15:
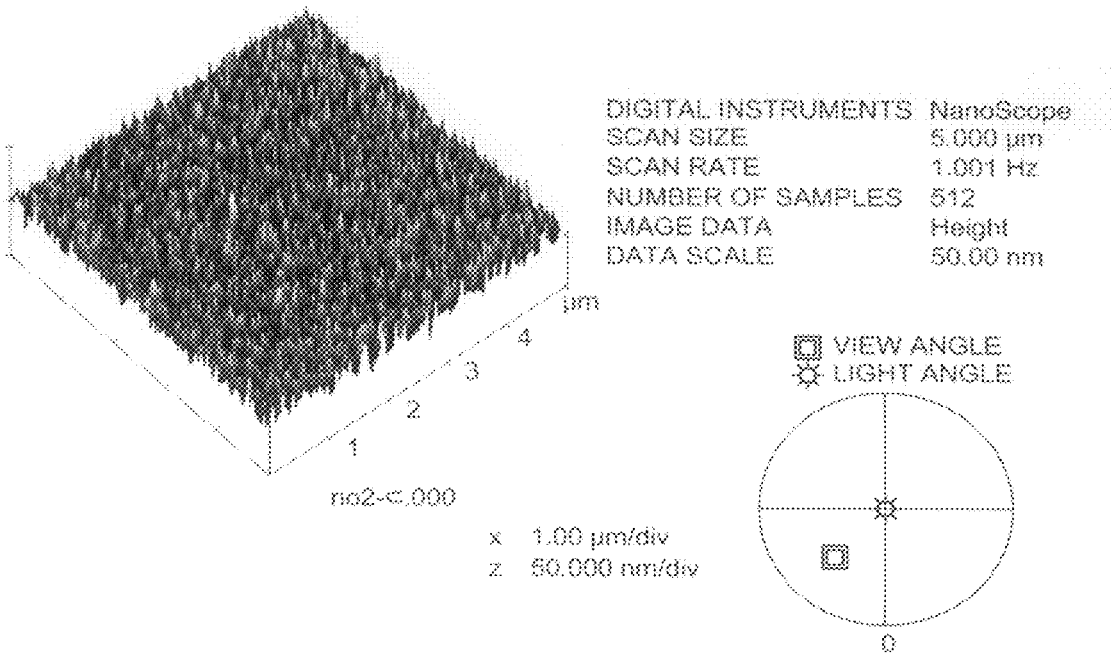
FIG. 15 is an enlarged view of a surface of the silicon wafer.

Alternatively, SF6 gas and octafluorocyclobutane (C4F8) gas can be alternately used for dry etching such that the surface roughness Ra of the silicon wafer increases to about 3.83 nanometers, as shown in FIG. 14. As a result, the surface becomes suitable for more refined polishing, as shown in FIG. 15, than in the case of using only SF6 gas.

Instead of using the silicon wafer, the polishing plate 113 can also be manufactured by coating a film of glass, ceramic, or silicon oxide (SiOx) over a base plate.

As described above, according to the first embodiment, the tip of a capillary is angle-polished on a plurality of sides by using a polishing plate. Dry etching is used to roughen the surface of the polishing plate. As a result, it is possible to achieve low-cost manufacturing of capillaries having a sufficiently large discharge opening and high penetrating ability.

Figure 16:
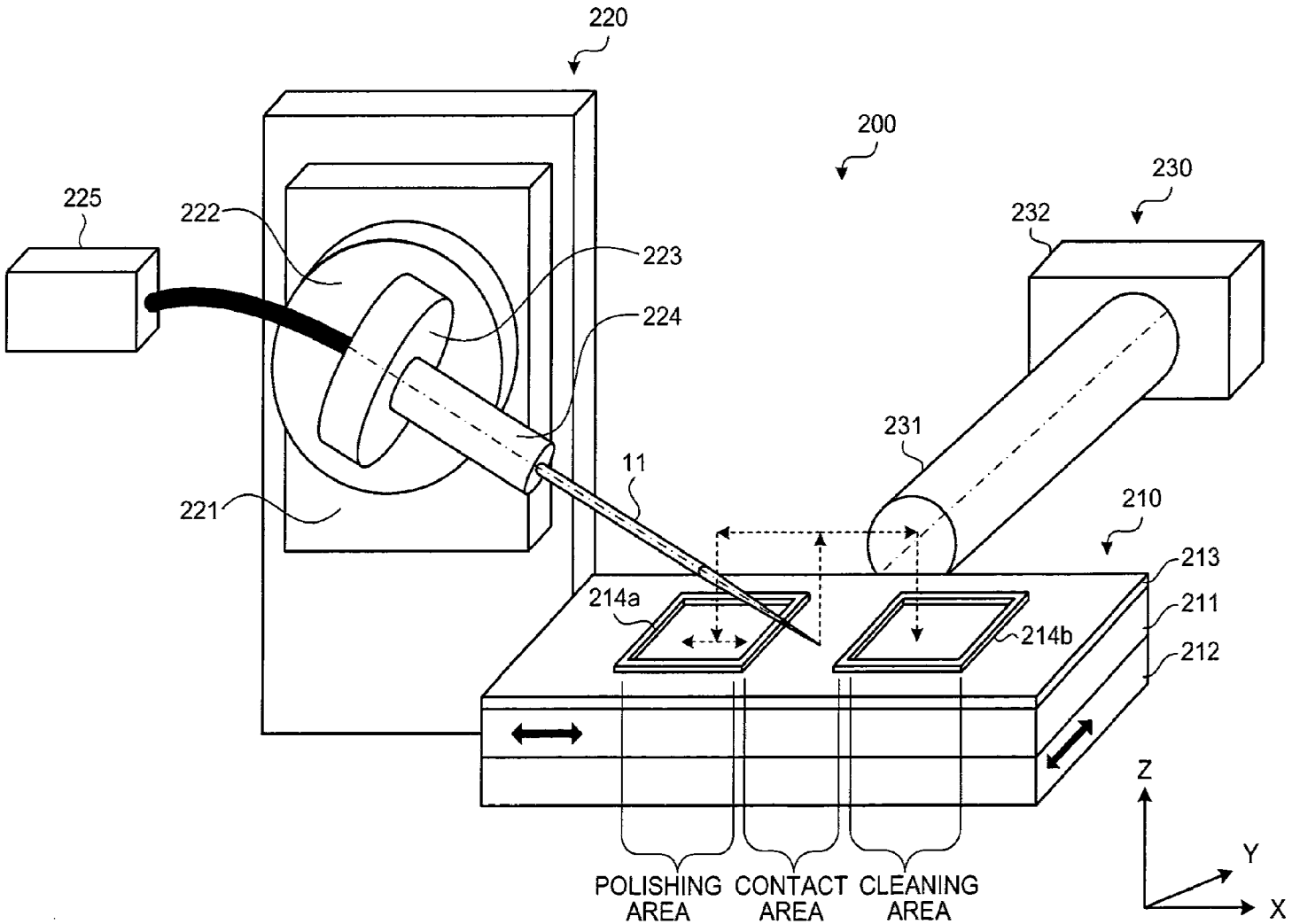
FIG. 16 is a schematic diagram of a capillary polishing apparatus according to a second embodiment of the present invention.

FIG. 16 is a schematic diagram of a capillary polishing apparatus 200 according to the second embodiment. The capillary polishing apparatus 200 includes a polishing mechanism 210, a capillary holding mechanism 220, and a monitoring mechanism 230. The polishing mechanism 210 includes a polishing plate 213, an X-axis stage 211 that horizontally moves the polishing plate 213 in the direction of X axis, and a Y-axis stage 212 that horizontally moves the polishing plate 213 in the direction of Y axis.

The capillary holding mechanism 220 includes a Z-axis stage 221 that moves the capillary 11 in the direction of Z axis, a first rotating stage 222 that rotates the capillary 11 around Y axis, a second rotating stage 223 that rotates the capillary 11 around its own axis, a holder 224 that holds the capillary 11, and a pressured-gas supplying unit 225 that supplies a pressured gas to the capillary 11.

The monitoring mechanism 230 includes a microscope 231 that determines the positional relation between the polishing plate 213 and the capillary 11, and a digital camera 232 attached to the microscope 231.

The monitoring mechanism is configured to move along with the X-axis stage 211, the Y-axis stage 212, and the Z-axis stage 221. The movement of each of the abovementioned stages, viz., the X-axis stage 211, the Y-axis stage 212, the Z-axis stage 221, the first rotating stage 222, and the second rotating stage 223 are controlled by a stage controlling unit (not shown).

The polishing plate 213 is manufactured to have the surface roughness Ra in the range from about 1 nanometer to 10 nanometers. There is no limitation on the material or the method of manufacturing the polishing plate 213 as long as the hardness of the polishing plate 213 is more than the capillary 11. It is preferred to manufacture the polishing plate 213 as described in the first embodiment.

The polishing plate 213 is divided into three areas, viz., a polishing area, a contact area, and a cleaning area. The polishing area is enclosed in a first partition 214*a*, while the cleaning area is enclosed in a second partition 214*b*. Both the polishing area and the cleaning area are filled with a liquid.

The process of polishing the capillary 11 in the capillary polishing apparatus 200 is performed in the order of a contact determination process in the contact area, a polishing process in the polishing area, and a cleaning process in the cleaning area. The capillary 11 is moved to each area by moving the abovementioned stages. The movement of the tip of the capillary 11 over the polishing plate 213 is shown by dotted arrows in FIG. 16.

The first partition 214*a* and the second partition 214*b* can be made of a leak-proof material such as a masking tape or a silicon rubber sheet. It is preferred that the first partition 214*a* and the second partition 214*b* protrude by less than 1 millimeter from the surface of the polishing plate 213 such that the capillary 11 can be moved freely without being obstructed by the first partition 214*a* and the second partition 214*b*.

The contact determination process determines a distance in the direction of Z axis at which the tip makes contact with the polishing plate 213. The stage controlling unit stores the distance in a storage unit (not shown) such as a memory such that it can be referred to for position adjustment during the polishing process or the cleaning process.

The polishing area is filled with a liquid to make the scattering pieces of the capillary 11 float in a liquid atmosphere. Similarly, the cleaning area on the polishing plate 213 is filled with a liquid to remove any residual pieces attached to the capillary 11 in another liquid atmosphere.

However, because the polishing area and the cleaning area are filled with a liquid, refraction of light occurs therein. That makes it difficult to precisely monitor the contact determination process by using the microscope 231. Hence, the contact determination process is not performed in the polishing area and the cleaning area, but in the open-to-air contact area.

If the microscope 231 is configured to enable precise monitoring of a tip of a capillary immersed in a liquid atmosphere, each of the contact area, the polishing area, and the cleaning area can be filled with a liquid.

With this, according to the second embodiment, scattering pieces of a capillary, which scatter around during the polishing process, can be prevented from getting attached to the capillary.

Figure 17:
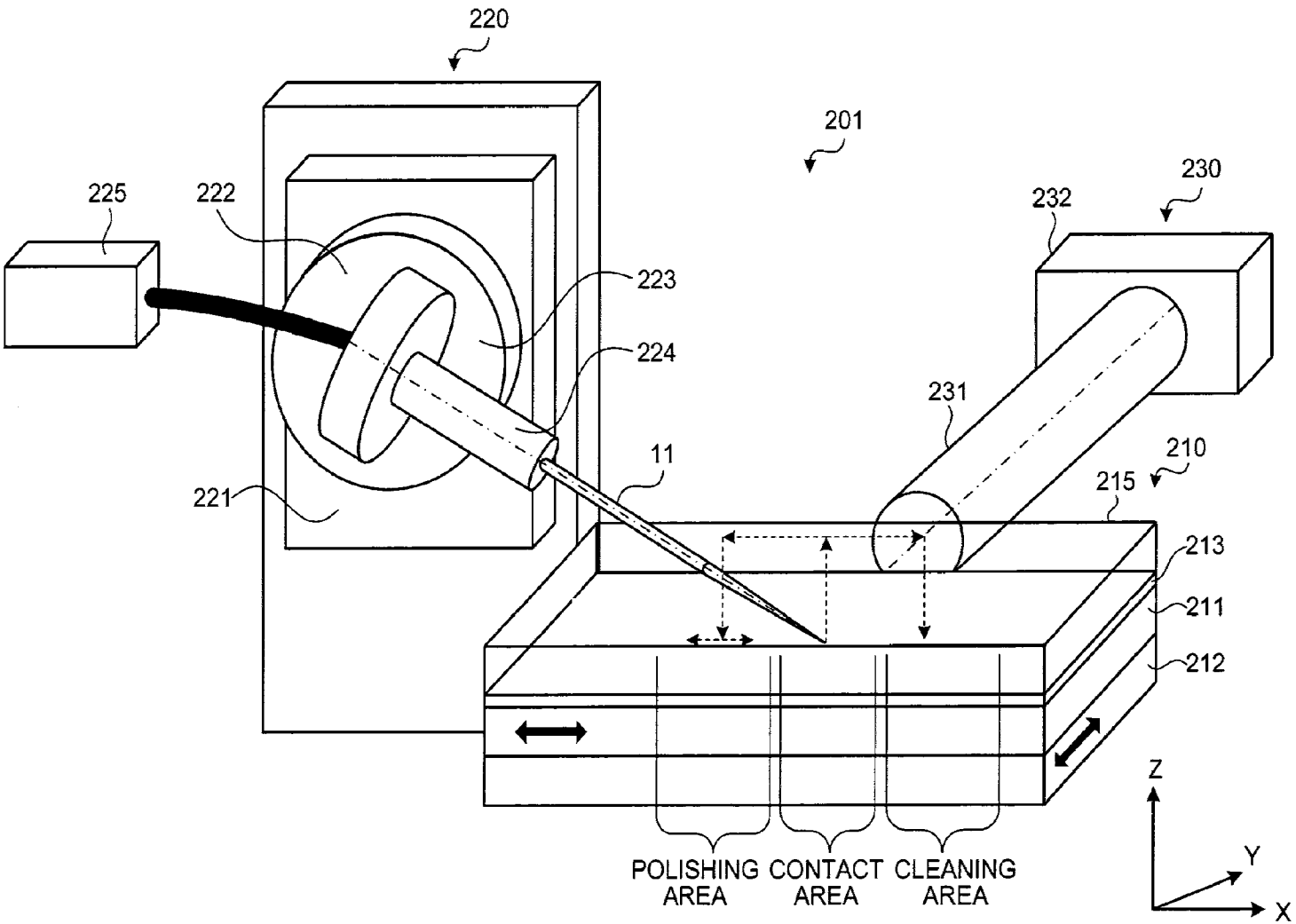
FIG. 17 is a schematic diagram of a capillary polishing apparatus according a first modification of the second embodiment.

FIG. 17 is a schematic diagram of a capillary polishing apparatus 201 according a first modification of the second embodiment. As shown in FIG. 17, a liquid-filled tank 215 is arranged superjacent to the polishing plate 213, and includes a contact area, a polishing area, and a cleaning area in a liquid. The microscope 231 has the tip immersed in the liquid. Hence, by placing the contact area, the polishing area, and the cleaning area in the same liquid, the light refraction in all the areas becomes uniform, which prevents deterioration of the monitoring precision. Moreover, the scattering pieces of the capillary 11 can also be removed as described above. Alternatively, the contact area in the tank 215 can be partitioned such that the scattering pieces from the polishing area or the cleaning area do not enter therein.

However, when the tip of the microscope 231 cannot be placed in a liquid atmosphere, it is preferred to arrange an open-to-air contact area as shown in FIG. 16. In that case, irrespective of the configuration of the microscope 231, monitoring precision is not affected by variation in refraction of light. At the same time, the scattering pieces of the capillary 11 can be removed.

As described above, the polishing area is enclosed in the first partition 214*a*, while the cleaning area is enclosed in the second partition 214*b*. However, as long as the polishing area and the cleaning area are filled with a liquid, any other technique to partition them can be used.

Figure 18:
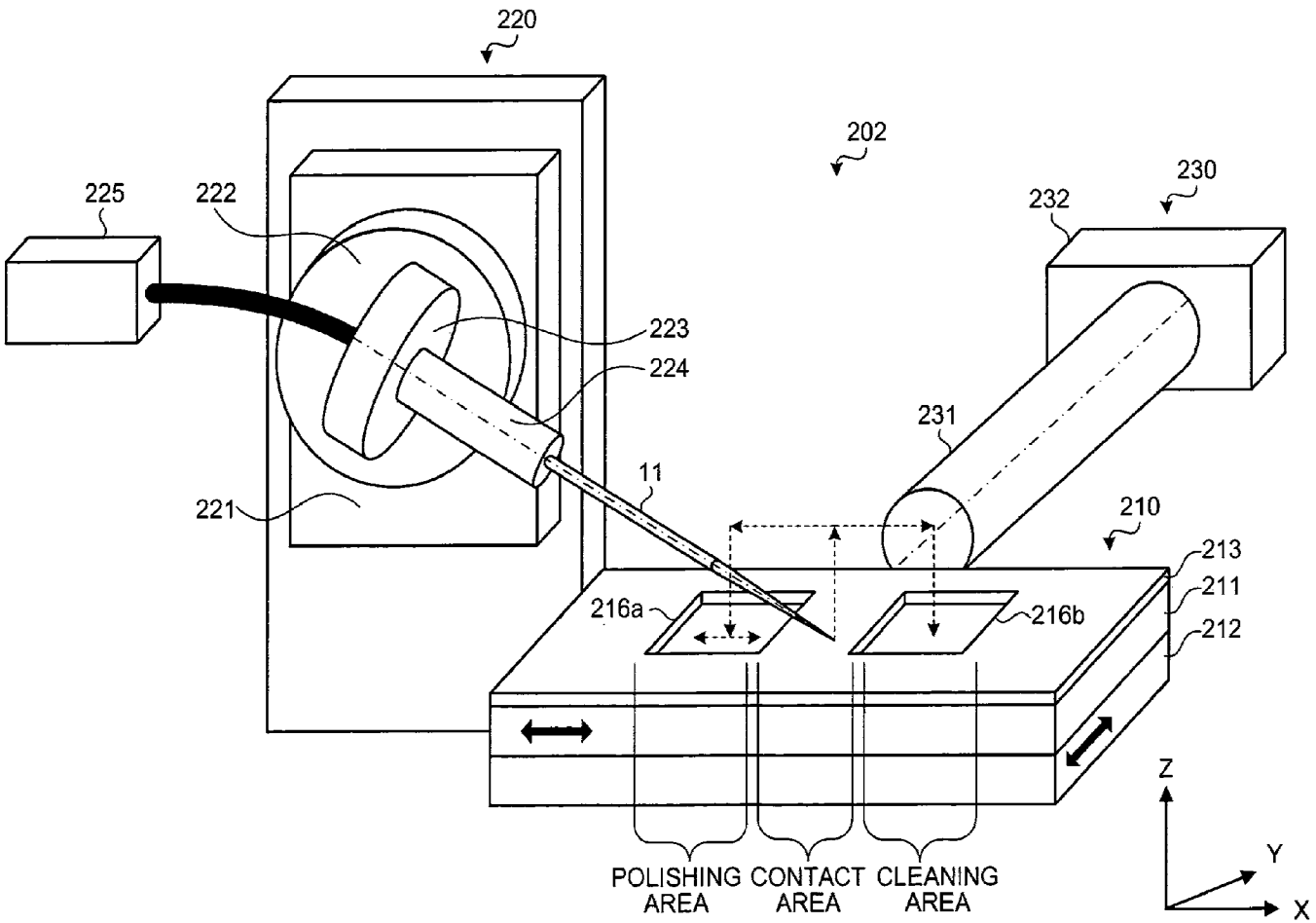
FIG. 18 is a schematic diagram of a capillary polishing apparatus according a second modification of the second embodiment.

Another technique of partitioning the polishing area and the cleaning area is given below. FIG. 18 is a schematic diagram of a capillary polishing apparatus 202 according a second modification of the second embodiment. As shown in FIG. 18, the polishing area and the cleaning area are partitioned in the form of depressions on the polishing plate 213. That is, a first depression 216*a* on the polishing plate 213 is used as the polishing area, while a second depression 216*b* is used as the cleaning area. Both the first depression 216*a* and the second depression 216*b* are filled with a liquid.

However, it is not necessary to configure the polishing area and the cleaning area as enclosed areas. Alternatively, to prevent flow of liquids into the contact area, linear partitions can be arranged between the contact area and each of the polishing area and the cleaning area. Moreover, the viscosity of the liquids filled in the polishing area and the cleaning area can be adjusted such that the liquids do not flow due to their surface tension.

It is also not necessary to arrange the cleaning area on the polishing plate 213 as described above. That is, the cleaning area can be arranged external to the polishing plate 213. For example, an external container filled with a liquid can be used as the cleaning area. Moreover, it is also not necessary to linearly arrange the polishing area, the contact area, and the cleaning area in that order. The order or the positional relation between the areas is irrelevant to the present invention.

The reason for arranging the open-to-air contact area, as described with reference to FIGS. 16 and 18, is to simplify the structure of the capillary polishing apparatus 200 and the capillary polishing apparatus 202 irrespective of the structure of the monitoring mechanism 230. In the case of the capillary polishing apparatus 200, the polishing area and the cleaning area are enclosed in the corresponding partitions; while in the case of the capillary polishing apparatus 202, the polishing area and the cleaning area are partitioned in the form of depressions on the polishing plate 213.

On the other hand, it is more difficult to monitor the tip when the capillary polishing apparatus 201 is used. That is because the contact area is arranged in the liquid-filled tank 215 with the polishing area and the cleaning area. To precisely monitor the tip in this case, an aperture can be created on the side of the tank 215 such that the lens of the microscope 231 can pass through the aperture into the tank 215. The aperture can then be puttied up. As a result, the microscope 231 is not affected by variation in refraction of light.

Basically, there is no restriction on the liquid used in each of the abovementioned areas. However, it is preferred to fill the polishing area with a liquid of relatively high surface tension (e.g., water) to prevent the liquid inflow due to capillarity action. On the other hand, it is preferred to fill the cleaning area with a liquid of relatively low surface tension (e.g., ethanol or surfactant agent) to facilitate the removal of the scattering pieces of the capillary 11.

Given below is the description of the process of polishing the capillary 11 by using the capillary polishing apparatus 200. The polishing process is divided into a focus adjustment process of the microscope 231, a contact determination process in the contact area, a polishing process in the polishing area, and a cleaning process in the cleaning area.

Figure 19:
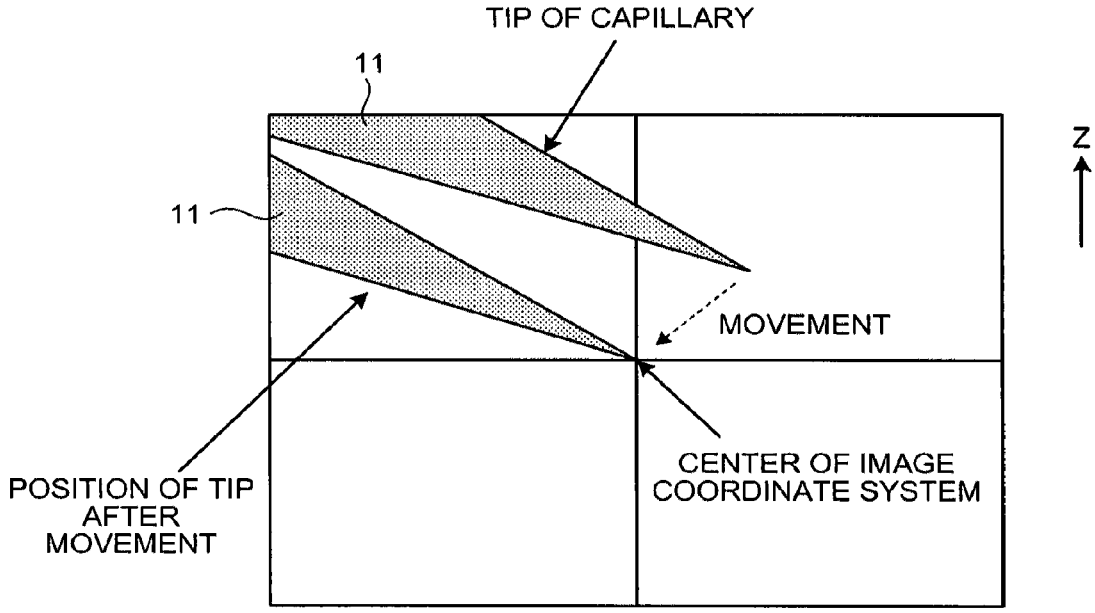
FIG. 19 is a schematic diagram for explaining movement of a tip of a capillary in an image coordinate system at the time of adjusting focus of a microscope.

FIG. 19 is a schematic diagram for explaining the movement of the tip at the time of adjusting the focus of the microscope 231. To approximate the tip to the polishing plate 213, it is first necessary to obtain an initial value of the positional relation between the polishing plate 213 and the tip. To obtain that, after the capillary 11 is fixed to the holder 224, the capillary 11 is moved down such that its tip lies within the image coordinate system of the microscope 231 (or the image coordinate system of the microscope 231 and, an image processing system such as the digital camera 232), at an arbitrary point over the polishing plate 213 (preferably over the contact area). The focus of the microscope 231 is then adjusted with respect to the tip. This process is referred to as the focus adjustment process.

The stage controlling unit controls the movement such that the tip is placed at the center of the image coordinate system. The stage controlling unit then stores in the storage unit the initial value of the positional relation between the polishing plate 213 and the tip. The initial value is referred to for adjusting the position of the tip during the contact determination process, the polishing process, or the cleaning process. After the focus adjustment process is complete, the contact determination is performed.

Figure 20A:
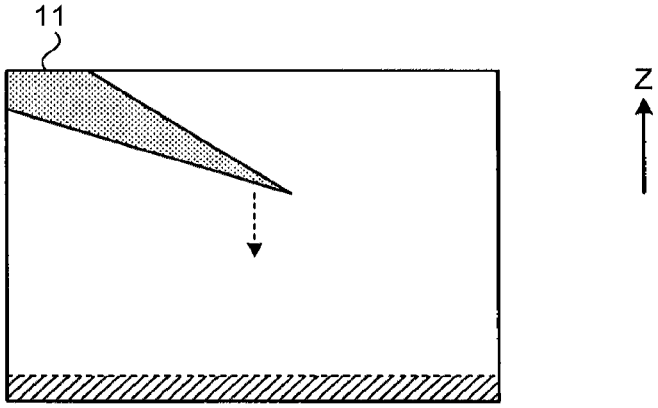
FIGS. 20A to 20C are schematic diagrams for explaining a contact determining process in a contact area shown in FIG. 16.
Figure 20B:
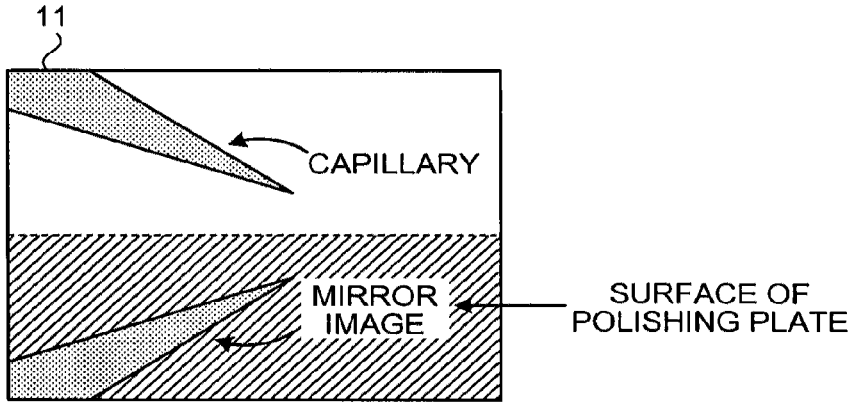
Figure 20C:
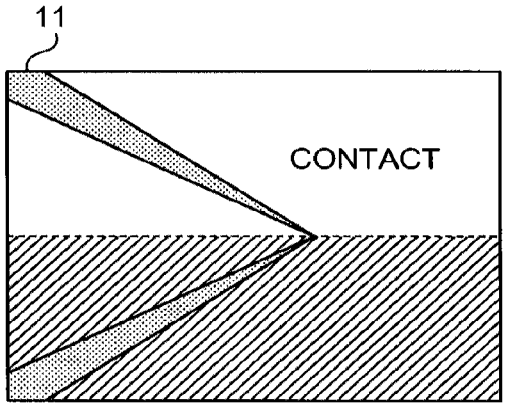

FIGS. 20A to 20C are schematic diagrams for explaining the contact determining process in the contact area. The shaded bottom portion in FIGS. 20A to 20C indicates the surface of the polishing plate 213. As shown in FIG. 20A, the Z-axis stage 221 moves down the capillary 11 towards the polishing plate 213 from the position at which the focus adjustment process has been performed.

When the tip approximates the polishing plate 213, a mirror image of the tip appears on the surface of the polishing plate 113 within the visual field. The Z-axis stage 121 is further moved down such that the actual tip makes contact with the mirror image. At that point, the movement of the Z-axis stage is stopped, and the position of the tip in the direction of Z axis is obtained.

The stage controlling unit then stores in the storage unit the position in the direction of Z axis. That position is referred to during the polishing process or the cleaning process.

Figure 21A:
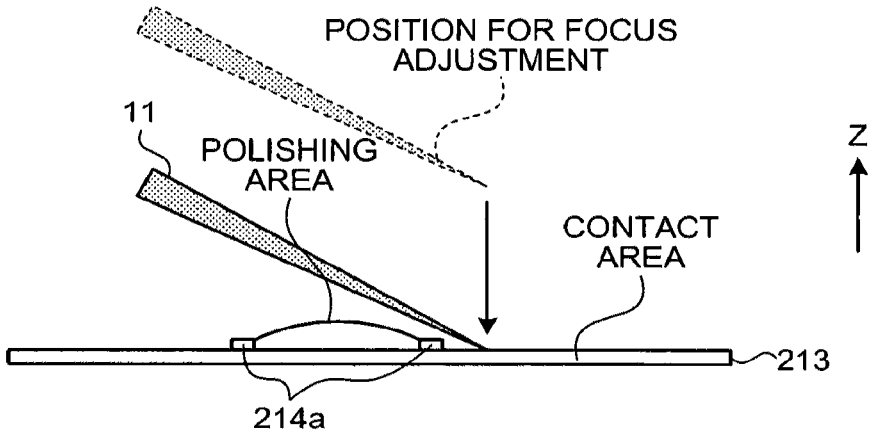
FIGS. 21A to 21C are schematic diagrams for explaining a polishing process in a polishing area shown in FIG. 16.
Figure 21B:
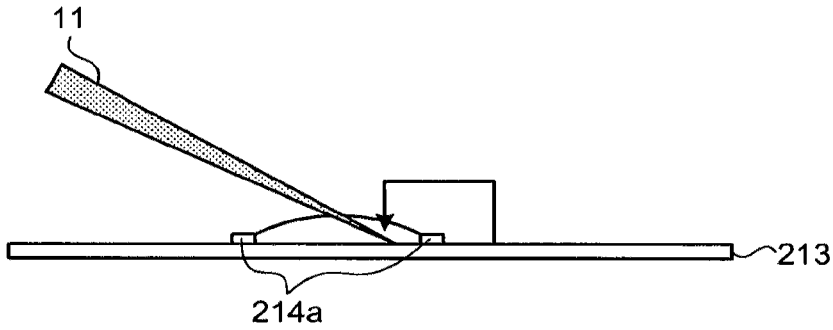
Figure 21C:
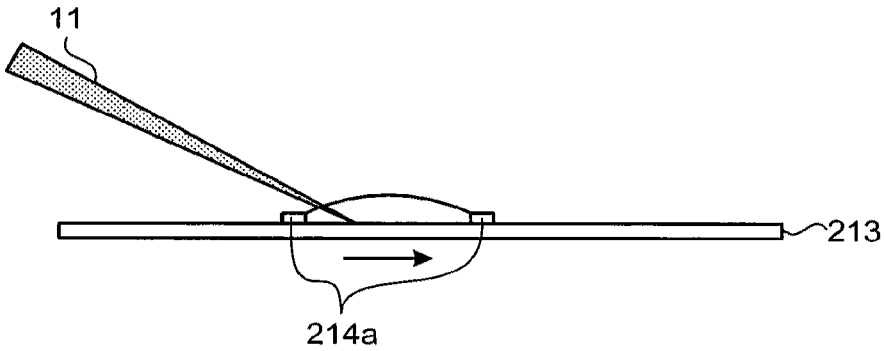

FIGS. 21A to 21C are schematic diagrams for explaining the polishing process of the tip in the polishing area. After the focus adjustment process and the contact determination process are complete, the tip is moved up in the direction of Z axis by a predetermined amount to prevent the tip from being obstructed by the first partition 214*a*, as shown in FIG. 21B.

When the first partition 214*a* is made of a masking tape or a silicon rubber sheet, it is preferred to move up the tip by about 1 millimeter. The tip is then moved parallel to the polishing plate 213 over a starting position of the polishing area. Finally, the tip is moved down by the same predetermined amount such that it is placed at the starting position.

Basically, the contact area and the polishing area can be arranged with an arbitrary gap therebetween. However, considering the surface gradient of the polishing plate 213 or the movement precision of the X-axis stage 211, it is preferred to maintain a small gap in the range of, e.g., 5 millimeters to 6 millimeters.

After the tip is placed at the starting position, the X-axis stage 211 horizontally moves the polishing plate 213 in the direction of X axis to start the polishing process. It is preferred to move the polishing plate 213 by 2.5 millimeters (polishing distance) at a polishing speed of 250 μm/s. However, those values can be determined based on the quality of material of the capillary 11 or the surface roughness of the polishing plate 113.

Figure 22A:
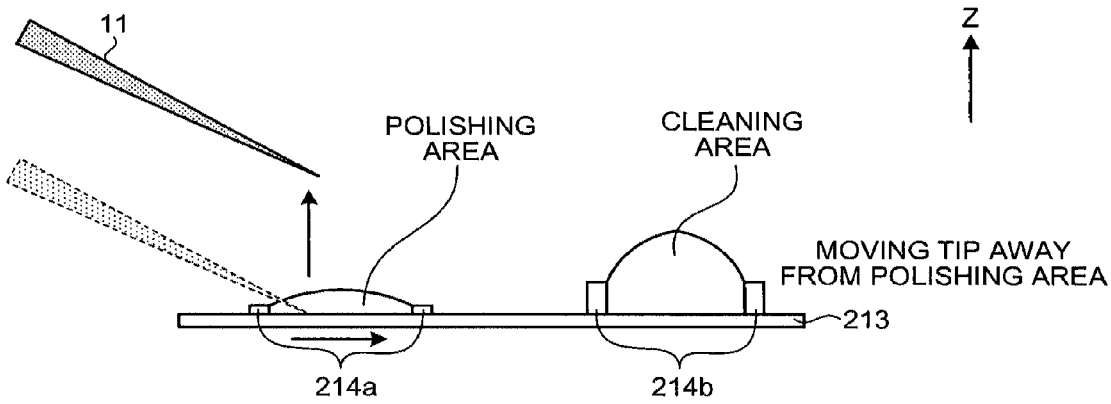
FIGS. 22A to 22C are schematic diagrams for explaining a cleaning process in a cleaning area shown in FIG. 16.
Figure 22B:
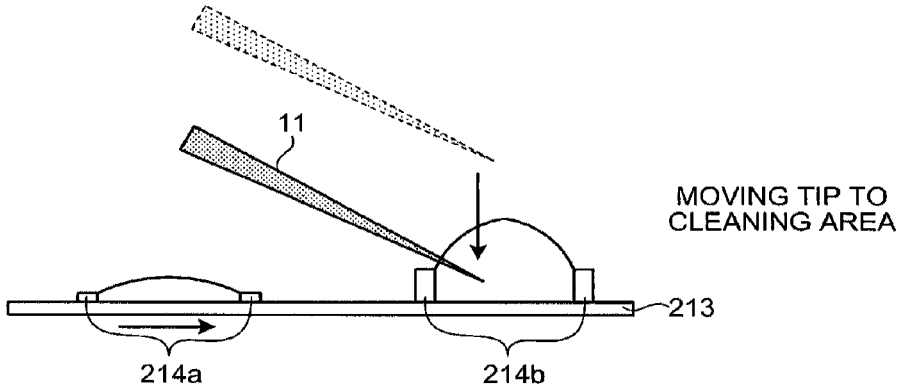
Figure 22C:
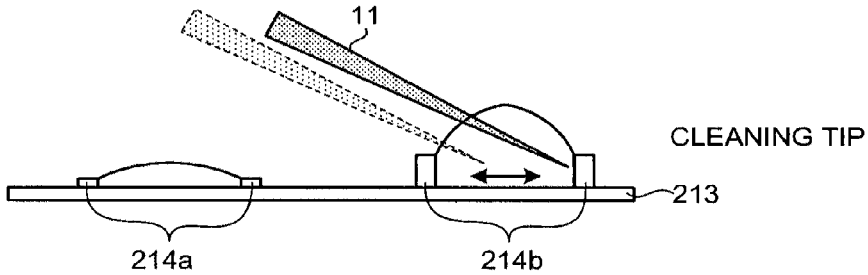

FIGS. 22A to 22C are schematic diagrams for explaining the cleaning process of the tip in the cleaning area. As shown in FIG. 22A, after the polishing process in the polishing area is complete, the tip is moved up in the direction of Z axis by a sufficient amount depending on the height of the first partition 214*a* and the second partition 214*b*.

The tip is then moved parallel to the polishing plate 213 over the cleaning area as shown in FIG. 22B. Finally, the tip is moved down to be immerse in the liquid filled in the cleaning area. The distance by which the tip is moved down is less than the distance by which it is moved up over the polishing area. The distance for moving the tip down is determined such that the tip does not make contact with the polishing plate 213 in the cleaning area.

Basically, the polishing area and the cleaning area can be arranged with an arbitrary gap therebetween. However, considering the surface gradient of the polishing plate 213 or the movement precision of the X-axis stage 211, it is preferred to maintain a small gap in the range of, e.g., 10 millimeters to 30 millimeters.

After the tip is immersed in the liquid in the cleaning area, the X-axis stage 211 or the Y-axis stage 212 horizontally moves the polishing plate 213 in its corresponding direction such that the scattering pieces of the capillary 11 are removed from the tip.

After the focus adjustment process, the contact determining process, the polishing process, and the cleaning process are complete, the capillary 11 is retracted to a standby position (not shown) that is sufficiently distant from the polishing plate 213. The capillary 11 is replaced with a new capillary at the standby position.

Meanwhile, to prevent the liquid inflow in the capillary 11 due to capillarity action in the polishing area or the cleaning area, it is necessary to pass a sufficiently filtered and pressured gas through the capillary 11. The pressured-gas supplying unit 225 supplies that pressured gas. The pressure of the gas is determined based on the inner diameter of the tip and maintained higher than an upward capillary pressure of the liquid in the polishing area. For example, if the inner diameter of the tip is 1 micrometer, it is preferred to supply a pressured gas of 500 kilopascal.

Moreover, the second rotating stage 223 is used for rotating the capillary 11 around its own axis to polish a plurality of sides of the tip. After the focus adjustment process, the contact determining process, and the polishing process are performed on one side of the tip, the second rotating stage 223 rotates by a predetermined angle such that the capillary 11 rotates around its own axis in the same angle and polishing is repeated on a second side of the tip. The cleaning process is performed after polishing on all required sides of the tip is complete. Alternatively, the cleaning process can be repeated along with the focus adjustment process, the contact determining process, and the polishing process after polishing each side of the tip.

As described above, according to the second embodiment and modifications thereof, the tip of a capillary is polished by using a polishing plate. The polishing plate is divided into three areas, viz., a polishing area, a contact area, and a cleaning area. First, the positional relation between the polishing plate and the tip is determined by controlling the movement of a plurality of stages in horizontal and vertical directions. Then, a microscope is used to determine the point of contact of the tip with the polishing plate. The point of contact lies in the contact area. The tip is then polished in the liquid-filled polishing area such that scattering pieces of the capillary, which scatter around during the polishing process, float in the liquid. As a result, capillaries having high puncture strength can be manufactured.

As described above, according to an embodiment of the present invention, automatically controlling the polishing of a tip of a capillary enables to achieve efficient polishing.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A capillary polishing method of polishing a tip of a capillary for microinjection, the method comprising:

first-polishing a first side of the tip by placing the tip on a polishing plate at a predetermined angle, pressing the tip against the polishing plate by a predetermined amount, and repeatedly moving the polishing plate at a predetermined speed by a predetermined distance with a pressured gas supplied to pass through the capillary such that the pressured gas comes out of the tip, the polishing plate having a surface roughened by dry etching;

rotating the capillary around an axis thereof to determine a second side of the tip; and second-polishing the second side by placing the tip on the polishing plate at a predetermined angle, pressing the tip against the polishing plate by a predetermined amount, and repeatedly moving the polishing plate at a predetermined speed by a predetermined distance with a pressured gas supplied to pass through the capillary such that the pressured gas comes out of the tip.

2. The capillary polishing method according to claim 1, wherein the rotating and the second-polishing are repeated at least two times.

3. The capillary polishing method according to claim 1, wherein an average surface roughness of the polishing plate is in a range from 1 micrometer to 10 micrometers.

4. The capillary polishing method according to claim 1, wherein the first-polishing includes polishing the first side in a polishing area on the polishing plate, the polishing area being enclosed in a partition and filled with a liquid, the polishing area being included in a liquid-filled tank arranged superjacent to the polishing plate or the polishing area being a depression on the polishing plate and filled with a liquid, and the second-polishing includes polishing the second side in the polishing area.

5. The capillary polishing method according to claim 4 further comprising cleaning the tip in a cleaning area on the polishing plate, the cleaning area being enclosed in a partition and filled with a liquid, the cleaning area being included in a liquid-filled tank arranged superjacent to the polishing plate or the cleaning area being a depression on the polishing plate and filled with a liquid.

6. The capillary polishing method according to claim 4 further comprising:

bringing, before any one of the first-polishing and the second-polishing, the tip into contact with the polishing plate in a contact area on the polishing plate to obtain a positional relation between the tip and the polishing plate when the tip makes contact with the polishing plate; and storing the positional relation, wherein the first-polishing includes polishing the first side based on the positional relation stored at the storing, and the second-polishing includes polishing the second side based on the positional relation.

7. The capillary polishing method according to claim 4, wherein pressure of the gas being higher than an upward capillary pressure of the liquid in the polishing area.

8. The capillary polishing method according to claim 5, wherein the tip is horizontally moved in the liquid in the cleaning area.

* * * * *